US006290660B1

(12) United States Patent
Epps et al.

(10) Patent No.: US 6,290,660 B1
(45) Date of Patent: Sep. 18, 2001

(54) AUTOMATED CHEST PERCUSSOR APPARATUS

(76) Inventors: Charlene Epps, 21913 Beaconsfield, East Pointe, MI (US) 48021; Ada Smith, 4324 N. 90th St., Milwaukee, WI (US) 53222

( * ) Notice: Subject to any disclaimer, the term of this patent is extended or adjusted under 35 U.S.C. 154(b) by 0 days.

(21) Appl. No.: 09/439,330

(22) Filed: Nov. 12, 1999

(51) Int. Cl.[7] ..... A61H 23/02; A61H 31/00

(52) U.S. Cl. ..... 601/41; 601/98; 601/103; 601/111

(58) Field of Search ..... 601/41, 97, 101, 601/103, 108, 134, 51–54, 98–100, 102, 107, 110, 111, 42–44

(56) References Cited

U.S. PATENT DOCUMENTS 1,833,103 * 11/1931 Anderson .
1,918,546 * 7/1933 Johnson .
2,267,138 * 12/1941 Scardamalia .
2,484,306 * 10/1949 McClain et al. .
3,289,673 * 12/1966 Russo .
3,489,140 * 1/1970 Mullikin .
4,041,938 * 8/1977 Wintoniw .
5,327,887 * 7/1994 Nowakowski .

FOREIGN PATENT DOCUMENTS

1476518 * 4/1967 (FR) ..... 601/97

* cited by examiner

*Primary Examiner*—Danton D. DeMille

(57) ABSTRACT

An automated chest percussor apparatus for dislodging and loosening pulmonary secretions in one's chest. The automated chest percussor apparatus includes a rectangular housing mounted upon a pair of adjustable telescopic legs, and further includes a motor, a rotatable shaft connected to the motor, a first cam mounted to the rotatable shaft near the motor, a second cam mounted to near the end of the rotatable shaft away from the motor, a first bushing supported by a support bracket and supporting the rotatable shaft between the first and second cams, a first tubular member being connected to the first cam and being movably extended through a bottom wall of the housing, a second bushing supporting the first tubular member, a first flange member being securely attached to an upper end of the first tubular member, a first spring member being mounted about the first tubular member and disposed between the first flange member and the bottom wall of the housing, a first percussor member being adjustably threaded through a bottom end of the first tubular member, a second tubular member being connected to the second cam and being movably extended through a bottom wall of the housing, a third bushing supporting the second tubular member, a second flange member being securely attached to an upper end of the second tubular member, a second spring member being mounted about the second tubular member and disposed between the second flange member and the bottom wall of the housing, a second percussor member being adjustably threaded through a bottom end of the second tubular member, and a power and control source.

1 Claim, 3 Drawing Sheets

AUTOMATED CHEST PERCUSSOR APPARATUS

BACKGROUND OF THE INVENTION

1. Field of the Invention

The present invention relates to an automated means for providing percussion action to one's chest and more particularly pertains to a new automated chest percussor apparatus for dislodging and loosening pulmonary secretions in one's chest.

2. Description of the Prior Art

The use of an automated means for providing percussion action to one's chest is known in the prior art. More specifically, an automated means for providing percussion action to one's chest heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,508,107; U.S. Pat. No. 3,425,409; U.S. Pat. No. 4,887,594; U.S. Pat. No. 5,399,148; U.S. Pat. No. 4,429,688; and U.S. Pat. No. 5,769,800.

While these devices fulfill their respective, particular objectives and requirements, the aforementioned patents do not disclose a new automated chest percussor apparatus. The inventive device includes a rectangular housing mounted upon a pair of adjustable telescopic legs, and further includes a motor, a rotatable shaft connected to the motor, a first cam mounted to the rotatable shaft near the motor, a second cam mounted to near the end of the rotatable shaft away from the motor, a first bushing supported by a support bracket 1 and supporting the rotatable shaft between the first and second cams, a first tubular member being connected to the first cam and being movably extended through a bottom wall of the housing, a second bushing supporting the first tubular member, a first flange member being securely attached to an upper end of the first tubular member, a first spring member being mounted about the first tubular member and disposed between the first flange member and the bottom wall of the housing, a first percussor member being adjustably threaded through a bottom end of the first tubular member, a second tubular member being connected to the second cam and being movably extended through a bottom wall of the housing, a third bushing supporting the second tubular member, a second flange member being securely attached to an upper end of the second tubular member, a second spring member being mounted about the second tubular member and disposed between the second flange member and the bottom wall of the housing, a second percussor member being adjustably threaded through a bottom end of the second tubular member, and a power and control source.

In these respects, the automated chest percussor apparatus according to the present invention substantially departs from the conventional concepts and designs of the prior art, and in so doing provides an apparatus primarily developed for the purpose of dislodging and loosening pulmonary secretions in one's chest.

SUMMARY OF THE INVENTION

In view of the foregoing disadvantages inherent in the known types of an automated means for providing percussion action to one's chest now present in the prior art, the present invention provides a new automated chest percussor apparatus construction wherein the same can be utilized for dislodging and loosening pulmonary secretions in one's chest.

The general purpose of the present invention, which will be described subsequently in greater detail, is to provide a new automated chest percussor apparatus which has many of the advantages of the an automated means for providing percussion action to one's chest mentioned heretofore and many novel features that result in a new automated chest percussor apparatus which is not anticipated, rendered obvious, suggested, or even implied by any of the prior art an automated means for providing percussion action to one's chest, either alone or in any combination thereof.

To attain this, the present invention generally comprises includes a rectangular housing mounted upon a pair of adjustable telescopic legs, and further includes a motor, a rotatable shaft connected to the motor, a first cam mounted to the rotatable shaft near the motor, a second cam mounted to near the end of the rotatable shaft away from the motor, a first bushing supported by a support bracket 1 and supporting the rotatable shaft between the first and second cams, a first tubular member being connected to the first cam and being movably extended through a bottom wall of the housing, a second bushing supporting the first tubular member, a first flange member being securely attached to an upper end of the first tubular member, a first spring member being mounted about the first tubular member and disposed between the first flange member and the bottom wall of the housing, a first percussor member being adjustably threaded through a bottom end of the first tubular member, a second tubular member being connected to the second cam and being movably extended through a bottom wall of the housing, a third bushing supporting the second tubular member, a second flange member being securely attached to an upper end of the second tubular member, a second spring member being mounted about the second tubular member and disposed between the second flange member and the bottom wall of the housing, a second percussor member being adjustably threaded through a bottom end of the second tubular member, and a power and control source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automated chest percussor apparatus which has many of the advantages of the an automated means for providing percussion action to one's chest mentioned heretofore and many novel features that result in a new automated chest percussor apparatus which is not anticipated, rendered obvious, suggested, or even implied by any of the prior art an automated means for providing percussion action to one's chest, either alone or in any combination thereof.

It is another object of the present invention to provide a new automated chest percussor apparatus which may be easily and efficiently manufactured and marketed.

It is a further object of the present invention to provide a new automated chest percussor apparatus which is of a durable and reliable construction.

An even further object of the present invention is to provide a new automated chest percussor apparatus which is susceptible of a low cost of manufacture with regard to both materials and labor, and which accordingly is then susceptible of low prices of sale to the consuming public, thereby making such automated chest percussor apparatus economically available to the buying public.

Still yet another object of the present invention is to provide a new automated chest percussor apparatus which provides in the apparatuses and methods of the prior art some of the advantages thereof, while simultaneously overcoming some of the disadvantages normally associated therewith.

Still another object of the present invention is to provide a new automated chest percussor apparatus for dislodging and loosening pulmonary secretions in one's chest.

Yet another object of the present invention is to provide a new automated chest percussor apparatus which includes a rectangular housing mounted upon a pair of adjustable telescopic legs, and further includes a motor, a rotatable shaft connected to the motor, a first cam mounted to the rotatable shaft near the motor, a second cam mounted to near the end of the rotatable shaft away from the motor, a first bushing supported by a suppot bracket and supporting the rotatable shaft between the first and second cams, a first tubular member being connected to the first cam and being movably extended through a bottom wall of the housing, a second bushing supporting the first tubular member, a first flange member being securely attached to an upper end of the first tubular member, a first spring member being mounted about the first tubular member and disposed between the first flange member and the bottom wall of the housing, a first percussor member being adjustably threaded through a bottom end of the first tubular member, a second tubular member being connected to the second cam and being movably extended through a bottom wall of the housing, a third bushing supporting the second tubular member, a second flange member being securely attached to an upper end of the second tubular member, a second spring member being mounted about the second tubular member and disposed between the second flange member and the bottom wall of the housing, a second percussor member being adjustably threaded through a bottom end of the second tubular member, and a power and control source.

Still yet another object of the present invention is to provide a new automated chest percussor apparatus that is much more effective than doing the percussions by hand or manually.

Even still another object of the present invention is to provide a new automated chest percussor apparatus that is easy, safe, and convenient to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
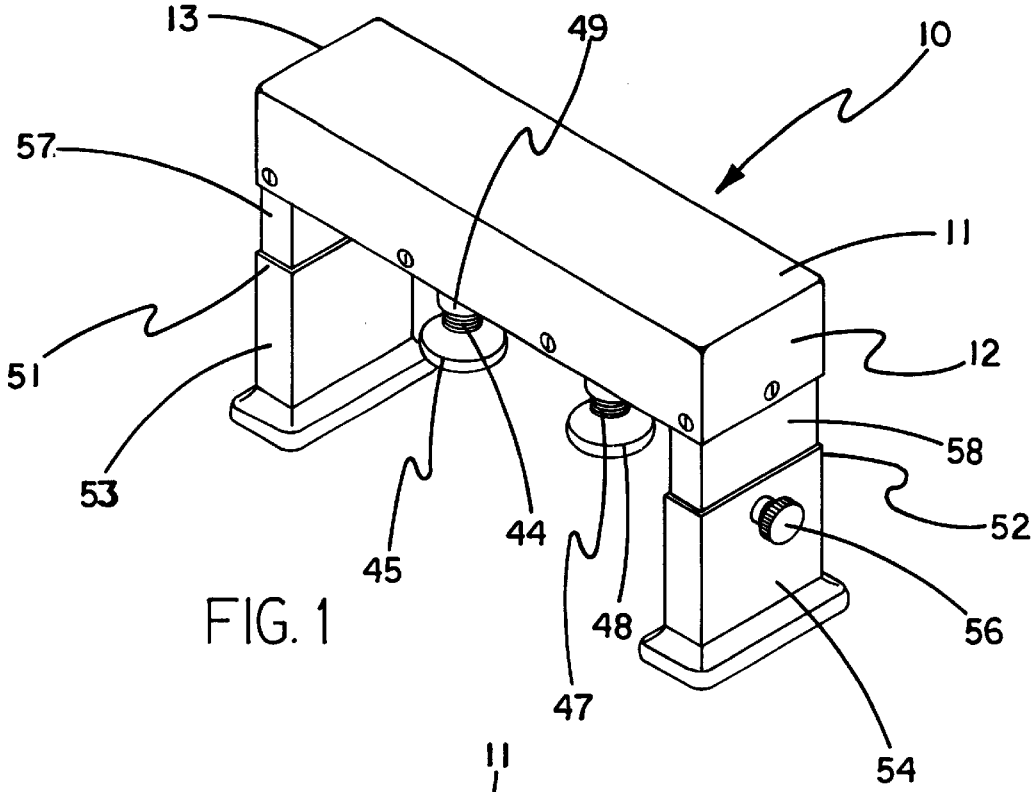
FIG. 1 is a perspective view of a new automated chest percussor apparatus according to the present invention.
Figure 2:
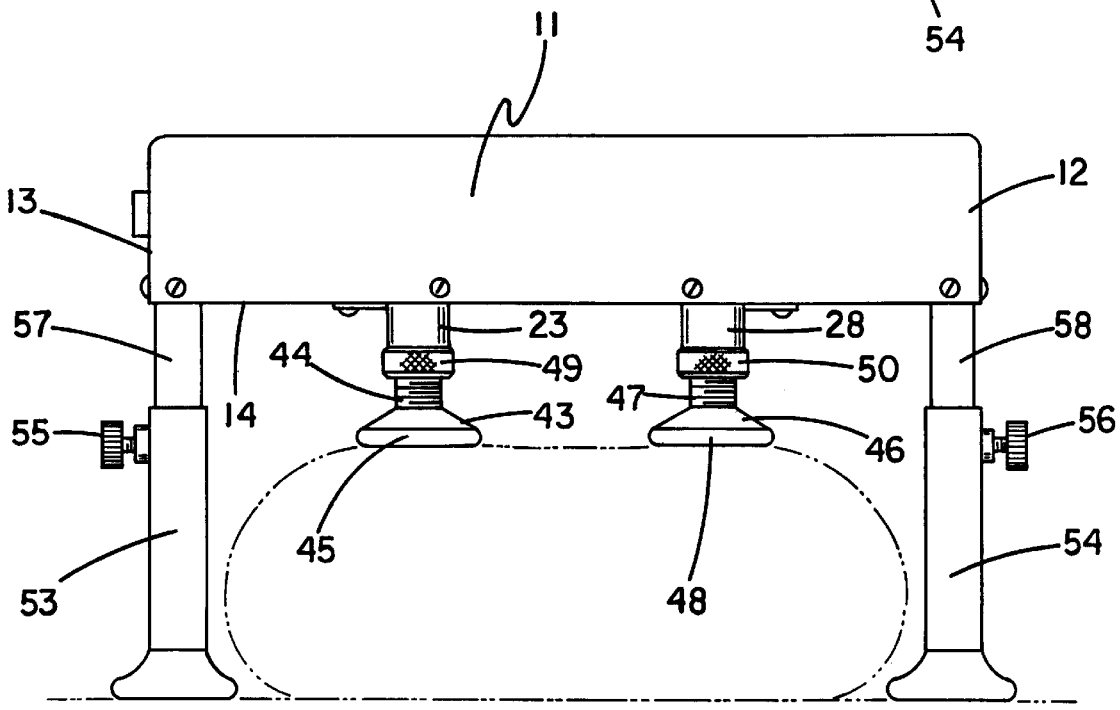
FIG. 2 is a side elevational view of the present invention.

With reference now to the drawings, and in particular to FIGS. 1 through 7 thereof, a new automated chest percussor apparatus embodying the principles and concepts of the present invention and generally designated by the reference numeral 10 will be described.

As best illustrated in FIGS. 1 through 7, the automated chest percussor apparatus 10 generally comprises a housing 11 having ends 12,13 and a bottom wall 14 and a plurality of adjustable telescopic legs 51,52 upon which the housing 11 is securely mounted. The adjustable telescopic legs 51,52 are securely attached with bolts to the ends 12,13 of the housing 11. Each of the adjustable telescopic legs 51,52 includes a base tubular member 53,54 having an open end, and also includes a housing support member 57,58 which is securely attached to the housing 11 and which is adjustably extendable through the open end of the base tubular member 53,54, and further includes a height adjustment member 55,56 being threaded through the base member 53,54 and being engageable to the housing support member 57,58.

A means for providing chest percussions includes a motor 15 securely disposed inside the housing 11 with fasteners; a rotatable shaft 16 conventionally connected to a motor shaft 30 of the motor 15; a first cam 17 securely and conventionally mounted about the shaft 16; and a second cam 18 securely and conventionally mounted about the shaft 16 and being spaced from the first cam 17. A percussor means comprises a first tubular member 23 being in contactable relationship with the first cam 17 and movably extending through the bottom wall 14 of the housing 11, and further comprises a second tubular member 28 being in contactable relationship with the second cam 18 and movably extending through the bottom wall 14 of the housing 11, and also comprises a first flange member 26 being securely disposed about the first tubular member 23, and further comprises a second flange member 41 being securely disposed about the second tubular member 28 with a first spring member 27 being mounted about the first tubular member 23 for urging the first tubular member 23 upwardly through the bottom wall 14 of the housing 11 and with a second spring member 42 being mounted about the second tubular member 28 for urging the second tubular member 28 upwardly through the bottom wall 14 of the housing 11 and with a first percussor member 43 being adjustably threaded through a bottom end 25 of the first tubular member 23 and with a second percussor member 46 being adjustably threaded through a bottom end 40 of the second tubular member 28. The first tubular member 23 has an upper end 24 which is in contactable relationship with the first cam 17 which is adapted to urge the first tubular member 23 downwardly through the bottom wall 14 of the housing 11. The second tubular member 28 has an upper end 29 which is in contactable relationship with the second cam 18 which is adapted to urge the second tubular member 28 downwardly through the bottom wall 14 of the housing 11. The first flange member 26 is securely disposed about the upper end 24 of the first tubular member 23. The second flange member 41 is securely disposed about the upper end 29 of the second tubular member 28 with the first spring member 27 being disposed against the first flange member 26 and the bottom wall 14 of the housing 11 and with the second spring member 42 being disposed against the second flange member 41 and the bottom wall 14 of the housing 11 The first percussor member 43 includes a first threaded shaft 44 and a first padded member 45 securely and conventionally disposed about a bottom end of the first threaded shaft 44. The first threaded shaft 44 is adjustably threaded with a first adjusting member 49 through a bottom end 25 of the first tubular member 23. The second percussor member 46 includes a second threaded shaft 47 and a second padded member 48 securely and conventionally disposed about a bottom end of the second threaded shaft 47 with the second threaded shaft 47 being adjustably threaded with a second adjusting member 50 through a bottom end 40 of the second tubular member 28. The first and second padded members are in contactable relationship with a person's chest. The motor 15 is a variable speed motor. The means for providing chest percussions further includes a support bracket 22 securely disposed inside the housing 11 with fasteners, a first bushing 19 securely and conventionally mounted to the support bracket 22 and being used to support the rotatable shaft 16, and also includes a second bushing 20 disposed inside the housing 11 and being used to support the first tubular member 23, and further includes a third bushing 21 also disposed inside the housing 11 and being used to support the second tubular member 28.

Figure 3:
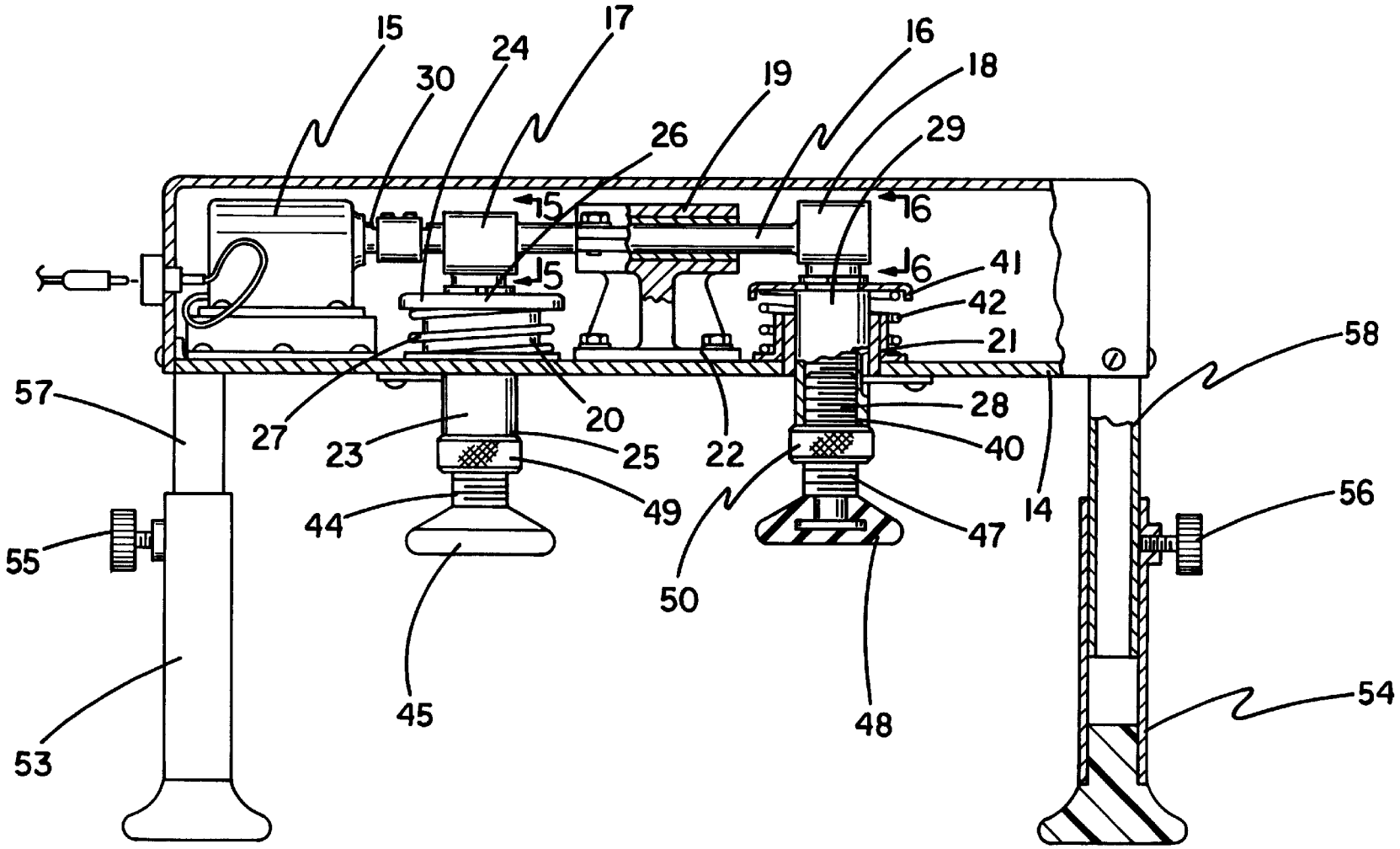
FIG. 3 is a side cross-sectional view of the present invention.
Figure 4:
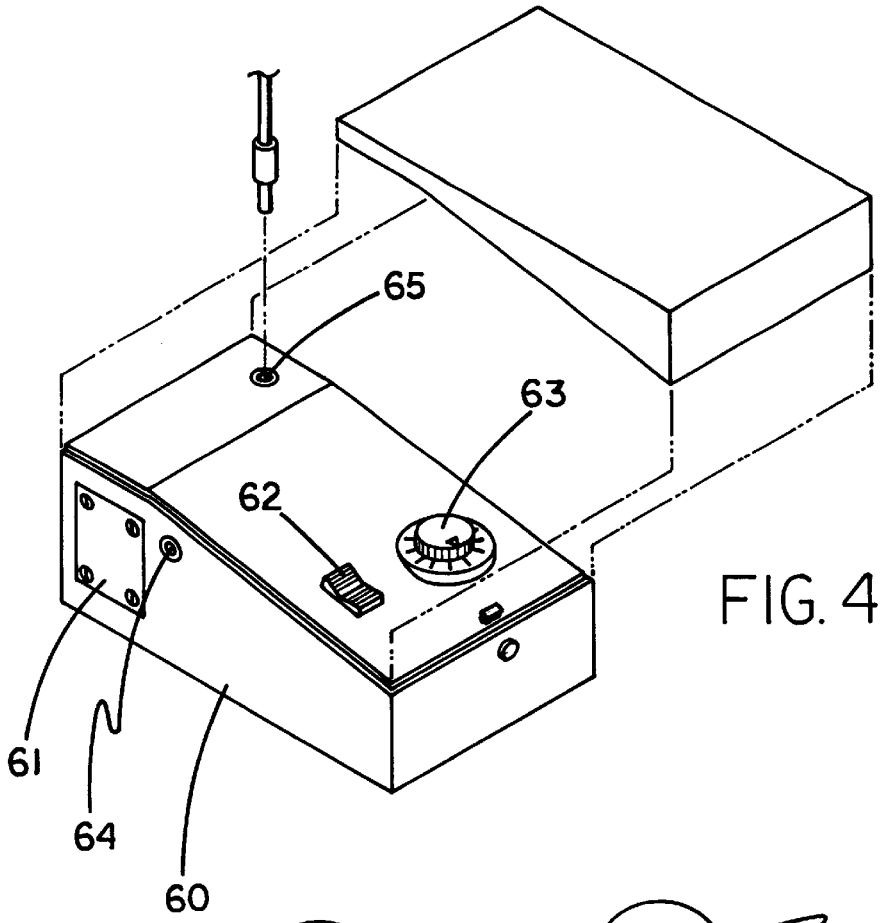
FIG. 4 is a perspective view of power and control source of the present invention.
Figure 5:
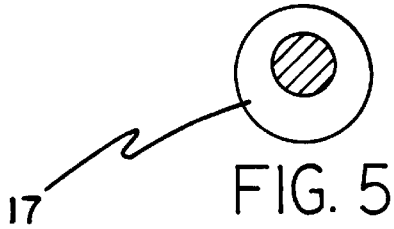
FIG. 5 is a detailed view of one of the cams of the present invention.
Figure 6:
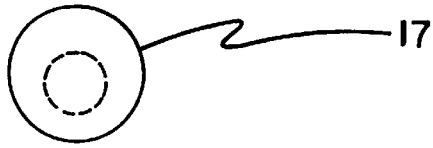
FIG. 6 is another detailed view of one of the cams of the present invention.
Figure 7:
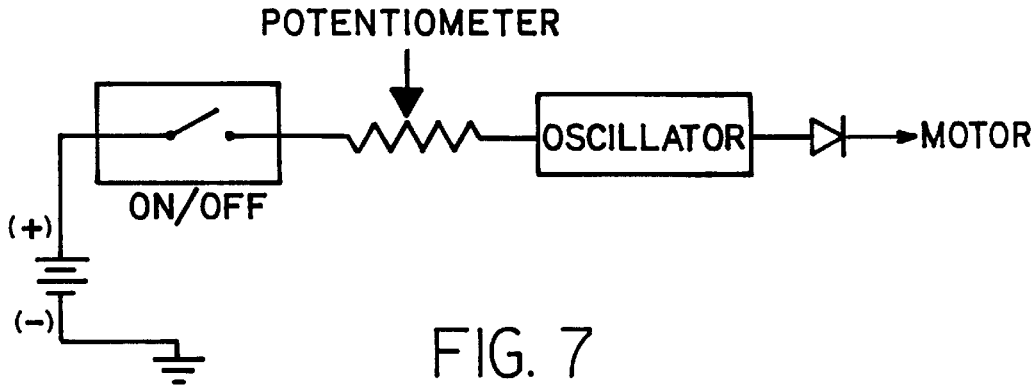
FIG. 7 is electrical schematic diagram of the present invention.

The first percussor member 43 and the second percussor member 46 may be mounted on the housing in a manner permitting movement of the first and second percussor members such that the first and second percussor members are simultaneously moveable in opposite directions (see the opposite positioning of the first and second percussor members in FIG. 3). As illustrated in FIGS. 3, 5, and 6, this opposite movement may be caused by the first cam 17 being positioned on the shaft 16 at a circumferential location opposite of a circumferential location of the second cam 18 on the shaft such that the first cam moves the first percussor member in a direction substantially opposite of direction that the second cam moves the second percussor member.

A power and control source for energizing the means for providing chest percussions includes a box-like member 60, a battery 61 disposed therein, an on/off switch 62 for energizing the motor 15, a speed control member 63 for controlling the speed of the motor 15, an adapter socket 64 for recharging the battery 61, and a power socket 65 to which a cable is inserted to energize the motor 15.

In use, the user would first adjust the height of the housing 11 above one's chest and further adjust the first and second percussor members according to the force of impact desired by the user. The user would then lie beneath the housing and turn on the power with the on/off switch 62 on the box-like member 60. The speed of the first and second percussor member can be controlled by the speed control member 63. The percussor members would impact the user's chest to loosen and dislodge the pulmonary secretions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An automated chest percussor apparatus comprising:

a housing having ends and a bottom wall;

a plurality of adjustable telescopic legs upon which said housing is securely mounted, said adjustable telescopic legs being securely attached to said ends of said housing, each of said adjustable telescopic legs including a base tubular member having an open end, and also including a housing support member which is securely attached to said housing and which is adjustably extendable through said open end of said base tubular member, and further including a height adjustment member being threaded through said base member and being engageable to said housing support member;

a means for providing chest percussions, including a motor disposed inside said housing; a rotatable shaft connected to said motor; a first cam securely mounted about said shaft; and a second cam securely mounted about said shaft and being spaced from said first cam; and a means for providing chest percussions, said means for providing chest percussions comprising a first tubular member being in contactable relationship with said first cam and movably extending through said bottom wall of said housing; a second tubular member being in contactable relationship with said second cam and movably extending through said bottom wall of said housing; a first flange member being securely disposed about said first tubular member; a second flange member being securely disposed about said second tubular member; a first spring member being mounted about said first tubular member for urging said first tubular member upwardly through said bottom wall of said housing; a second spring member being mounted about said second tubular member for urging said second tubular member upwardly through said bottom wall of said housing; a first percussor member being adjustably threaded through a bottom end of said first tubular member; and a second percussor member being adjustably threaded through a bottom end of said second tubular member, said first tubular member having an upper end which is in contactable relationship with said first cam which is adapted to urge said first tubular member downwardly through said bottom wall of said housing; said second tubular member having an upper end which is in contactable relationship with said second cam which is adapted to urge said second tubular member downwardly through said bottom wall of said housing, said first flange member being securely disposed about said upper end of said first tubular member; said second flange member being securely disposed about said upper end of said second tubular member, said first spring member being disposed against said first flange member and said bottom wall of said housing; said second spring member being disposed against said second flange member and said bottom wall of said housing, said first percussor member including a first threaded shaft and a first padded member disposed about a bottom end of said first threaded shaft, said first threaded shaft being adjustably threaded with a first adjusting member through a bottom end of said first tubular member; said second percussor member including a second threaded shaft and a second padded member disposed about a bottom end of said second threaded shaft, said second threaded shaft being adjustably threaded with a second adjusting member through a bottom end of said second tubular member, said first and second padded members being in contactable relationship with a person's chest, wherein said first percussor member and said second percussor member being mounted on said housing in a manner permitting movement of said first and second percussor members such that said first and second percussor members are simultaneously moveable in opposite directions, said first cam being positioned on said shaft at a circumferential location opposite a circumferential location of said second cam on said shaft such that said first cam moves said first percussor member in a direction substantially opposite of a direction that said second cam moves said second percussor member;

said motor being a variable speed motor, a means for providing chest percussions further including a support bracket securely disposed inside said housing, a first bushing securely mounted to said support bracket and supporting said rotatable shaft, a second bushing disposed inside said housing and supporting said first tubular member, and a third bushing also disposed inside said housing and supporting said second tubular member; and a power and control source for energizing said means for providing chest percussions, said power and control source including a box-like member, a battery disposed therein, an on/off switch for energizing said motor, a speed control member for controlling the speed of said motor, an adapter socket for recharging said battery, and a power socket to which a cable is inserted to energize said motor.

* * * * *